United States Patent [19]

Ogura et al.

[11] 4,317,849

[45] Mar. 2, 1982

[54] PROCESS FOR PRODUCING HIGH-GLOSS COATED PAPER

[75] Inventors: Toshimasa Ogura, Tokyo; Masafumi Masuda, Kashiwa, both of Japan

[73] Assignee: Mitsubishi Paper Mills, Ltd., Tokyo, Japan

[21] Appl. No.: 203,223

[22] Filed: Oct. 31, 1980

[30] Foreign Application Priority Data

| | | | |
|---|---|---|---|
| Nov. 6, 1979 | [JP] | Japan | 54-143657 |
| Dec. 29, 1979 | [JP] | Japan | 54-172984 |
| Jan. 24, 1980 | [JP] | Japan | 55-7158 |

[51] Int. Cl.[3] ..... B05D 3/02; B05D 3/12

[52] U.S. Cl. ..... 427/362; 427/366; 427/391

[58] Field of Search ..... 427/361, 362, 365, 366, 427/391

[56] References Cited

U.S. PATENT DOCUMENTS 3,873,345 3/1975 Vreeland .

4,241,143 12/1980 Ashio et al. ..... 427/362 X

*Primary Examiner*—Michael R. Lusignan

*Attorney, Agent, or Firm*—Cushman, Darby & Cushman

[57] ABSTRACT

A high-gloss coated paper can be produced by coating a paper or a prime-coated paper with an aqueous coating solution comprising a synthetic polymer latex (A) having a glass transition temperature of at least 38° C. and a synthetic polymer latex (B) having a glass transition temperature of 5° to 25° C. in a weight ratio of 1:0.1 to 1:1 in terms of solid content, drying the coated paper, and then bringing the coated surface into contact with a hot calender under pressure at a temperature not lower than the glass transition temperature of the synthetic polymer latex (A), thereby forming a mirror-finishing on the surface of the coated paper.

6 Claims, No Drawings

PROCESS FOR PRODUCING HIGH-GLOSS COATED PAPER

BACKGROUND OF THE INVENTION

1. Field of the Invention

This invention relates to a process for producing a high-gloss coated paper, which comprises subjecting to a hot calender treatment a coated paper in which is used an aqueous coating solution comprising a pigment, a synthetic polymer latex (A) having a glass transition temperature of at least 38° C. and a synthetic polymer latex (B) having a glass transition temperature of 5° to 25° C.

2. Description of the Prior Art

High-gloss coated papers can be produced by the application of an aqueous coating solution comprising a pigment and a thermoplastic binder and subsequently imparting gloss to the coated paper by means of hot calendering such as supercalendering or gloss-calendering. The supercalendering for imparting gloss to the coated paper is carried out at a linear pressure of about 200 kg/cm, which is a relatively high nip pressure, at a steel finishing roll temperature of about 70° C. The supercalendering is disadvantageous in that it compresses and densifies the coated paper. On the other hand, a method of finishing a paper surface by means of a hot calender known as "gloss-calendering" comprises pressing a coated paper against a polished finishing drum under temperature conditions sufficient to cause a temporary plastic state on the paper surface, to finish the paper surface. This method provides a coated paper with a bulky quality as compared with supercalendering, whereby a coated paper for printing having excellent opacity is obtained.

The pressure used in the gloss-calender is generally lower than that in the supercalender and is about 90 kg/cm, and the temperature used is as high as about 150° C.

The aqueous coating solution for producing a coated paper usually contains a pigment such as clay, calcium carbonate, aluminum hydroxide, titanium dioxide, satin white or the like, and a binder for sticking the pigment on the paper. As the binder, casein has heretofore been used. In recent years, however, starch is almost always used because casein is expensive and is difficult to make into a solution with a high concentration, and in general a synthetic polymer latex is used together with starch, whereby the low binding strength, low water resistance of the coated surface, and the like which are the disadvantages of starch, are removed. The synthetic polymer latex for coating a paper comprises as essential constituents styrene, butadiene and an acrylic ester, and makers use different mixing proportions and the glass transition temperature Tg of the polymer is generally −20° to 0° C. When a synthetic polymer latex having a Tg of −20° to 0° C., namely lower than 5° C., is used, the coated paper is relatively low in white-paper gloss and print gloss, and no high-gloss paper can be obtained. Furthermore, the coated paper is not sufficient in surface strength in wet state. It is described in U.S. Pat. No. 3,873,345 that in order to produce a high-gloss paper, a synthetic polymer latex having a high Tg of 38° C. or higher is used.

When a synthetic polymer latex having a Tg of at least 38° C. is used and the coated paper is mirror-finished at so high a temperature in the hot calender that the temperature of the coated surface immediately after the finishing becomes a temperature higher than the Tg of the polymer latex having a Tg of at least 38° C. the coated paper is very high in paper gloss, good in ink setting, but the print-gloss is insufficient, and the surface strength is also low and is not sufficient. When the finishing speed is extremely low and the temperature of the hot calender and the pressure under which the coated surface is pressed against the hot calender are extremely high in the mirror-finishing of the coated paper, a sufficient surface strength of the coated paper can be obtained. However, the printability and workability of the coated paper are significantly impaired. That is to say, troubles such as a deterioration in ink setting, an increase in curl, an increase in stain on the hot calender, and the like occur. Therefore, the coated paper obtained under such conditions cannot be used in practice. On the other hand, when the coated paper is finished at such a low temperature in the hot calender that the temperature of the coated surface immediately after the mirror-finishing becomes a temperature lower than the Tg of the synthetic polymer latex having a Tg of at least 38° C., the surface strength of the coated paper is significantly decreased in both dry and wet conditions, and the print gloss is also greatly reduced. When a synthetic polymer latex having a Tg of less than 5° C. and a synthetic polymer latex having a Tg of at least 38° C. are used at the same time and the coated paper is mirror-finished at so high a temperature in the hot calender that the temperature of the coated surface immediately after the finishing becomes a temperature higher than the Tg of the polymer latex having a Tg of at least 38° C., the surface strength of the coated paper increases and becomes substantially satisfactory in the dry condition, but is not satisfactory in the wet condition. The print gloss increases somewhat, but the white-paper gloss is low and the setting is bad.

SUMMARY OF THE INVENTION

In recent years, the printing speed is increased by the progress of printing techniques, and almost all printing inks have become inks which are high in viscoelasticity. In order to cope with these printing conditions, there has increasingly come to be required coated papers for printing which can respond to these printing conditions and in addition are excellent in gloss, ink transfer, dot-reproducibility, and printing result. In order to meet such requirements, the present inventors have conducted research on efficiently producing a coated paper which is rich in paper gloss and print gloss, has such a high coated surface strength that it can withstand high-speed printing, and is excellent in printability such as ink setting and the like.

According to this invention, there is provided a process for producing a high-gloss coated paper by coating a paper on a prime-coated paper with an aqueous coating solution comprising a synthetic polymer latex (A) having a glass transition temperature of at least 38° C., a synthetic polymer latex (B) having a glass transition temperature lower than that of (A), and a pigment for coated papers, drying the coated paper thus obtained and then bringing the coated surface into contact with a hot calender under pressure at a temperature not lower than the glass transition temperature of the synthetic polymer latex (A), thereby mirror-finishing the coated paper, characterized in that the glass transition temperature of the synthetic polymer latex (B) is 5° to 25° C., and the weight ratio in terms of solids of the synthetic polymer latex (A) to the synthetic polymer latex (B) is 1:0.1–1:1, preferably 1:0.2–1:0.67.

The coated paper obtained by the process of this invention is rich in paper gloss and print gloss, good in ink setting, very high in coated surface strength in both dry and wet conditions, and hence has sufficiently satisfactory characteristics as high-gloss coated paper. The use of a paper or a prime-coated paper having a Cobb size degree (after the contact with water for 5 seconds) of 0.4–10 g/m$^2$, preferably 2–7 g/m$^2$, is more advantageous for obtaining a high-gloss coated paper which is rich in paper gloss and print gloss, good in smoothness, and high in coated surface strength in both dry and wet conditions, namely has sufficiently satisfactory characteristics.

Further, when the coated paper is passed between the rolls at a linear pressure of 1–50 kg/cm, preferably 10–40 kg/cm at a paper surface temperature lower than the Tg of the synthetic polymer latex having a Tg of at least 38° C. immediately before mirror-finishing the coated paper by bringing the coated surface into contact with a hot calender under pressure, a high-gloss paper having little stain on it can be produced, and it is more advantageous for obtaining a coated paper which is rich in paper gloss and print gloss and good in smoothness, namely has sufficiently satisfactory characteristics.

DETAILED DESCRIPTION OF THE INVENTION

As the synthetic polymer latices, those having a Tg of −20° to 0° C. have heretofore been used as synthetic polymer latices for coating paper. When these synthetic latices are replaced by a synthetic polymer latex having a Tg of 5° to 25° C., the paper gloss and the print gloss are increased by treating the coated paper by means of a hot calender at a temperature equal to or higher than the Tg of the latex. However, as high-gloss paper, it is yet too low, for example, in paper gloss value, that is to say, the resulting coated paper cannot be considered to be a so-called high-gloss coated paper. The coated paper is high in coated-surface strength, but insufficient in ink setting. In order to obtain a high-gloss coated paper having further increased paper gloss and print gloss and improved ink setting, without impairing the coated-surface strength, it is necessary to use a synthetic polymer latex having a Tg of at least 38° C. together with a synthetic polymer latex having a Tg of 5° to 25° C.

That is to say, when a synthetic polymer latex having a Tg of less than 5° C. is used as the latex along with the synthetic polymer latex having a Tg of at least 38° C., the coated paper decreases in gloss and cannot be desired to be remarkably improved in strength. When a synthetic polymer latex having a Tg of more than 25° C. is used, the gloss of the coated paper does not decrease but no improvement in strength cannot be expected.

The amount of the synthetic polymer latex having a Tg of 5° to 25° C. is not critical though the amount is preferably from 2 to 25 parts by weight in terms of solids per 100 parts by weight of the pigment. The weight ratio in terms of solids of the synthetic polymer latex (A) having a Tg of at least 38° C. to the synthetic polymer latex (B) having a Tg of 5° to 25° C. is 1:0.1–1:1, preferably 1:0.2–1:0.67.

When the amount of the synthetic polymer latex (B) having a Tg of 5° to 25° C. is such an amount that the weight ratio of the synthetic polymer latex (B) to the synthetic polymer latex (A) having a Tg of at least 38° C. is lower than 0.1 in terms of solids, the coted surface strength cannot be expected to be greatly improved, and when it is higher than 1.0, the gloss is greatly reduced. When it ranges from 0.2 to 0.67, there can be obtained a high-gloss coated paper which is high in coated surface strength in both dry and wet conditions, rich in paper gloss and print gloss, good in ink setting, and hence has sufficiently satisfactory characteristics.

The Cobb size degree of the paper or the prime-coated paper used in this invention is preferably 0.4–10 g/m$^2$, particularly preferably 2–7 g/cm$^2$.

The reason why it is preferred that the Cobb size degree of the paper or the prime-coated paper fall in the above-mentioned range is as follows. In order to carry out the plastic transformation of the coating layer when the coating layer is momentarily brought into contact with the hot surface of the calender roll under pressure in order to obtain high gloss, the water content in the coating layer is an important factor. Of course, a larger water content is preferred for the transformation. However, when the water content is excessive, the heated surface is stained. The efficient retention of the water content to a suitable degree in the coating layer at the time of the contact under pressure is important for obtaining a high-gloss surface with good workability. For this purpose, it is very effective to adjust the Cobb size degree after the paper or the prime-coated paper has contacted with water for 5 seconds to 0.4–10 g/m$^2$, preferably 2–7 g/m$^2$.

When the Cobb size degree after the paper or the prime-coated paper has contacted with water for 5 seconds exceeds 10 g/m$^2$, the water content in the coating layer is not completely retained during the plastic transformation of the coating layer between the heated rolls, so that better gloss cannot be obtained. On the other hand, when the Cobb size degree is less than 0.4 g/m$^2$, the binder in the coating solution does not penetrate into the paper sufficiently, and hence the coated surface strength is lowered.

Particularly when the Cobb size degree is within the range of 2–7 g/m$^2$, there can be obtaind a high-gloss coated paper which is rich in paper gloss and print gloss, good in smoothness, high in coated surface strength in both dry and wet conditions, and hence has sufficiently satisfactory characteristics.

The Cobb size degree mentioned above is a value measured according to a method shown in JIS P 8140. The reason why the measurement time is particularly defined as 5 seconds is as follows. When the Cobb size degree is obtained by using too long a measurement time, it is difficult to make a difference between the measured values, and the effects obtained in this invention becomes difficult to explain. Therefore, the shorter the measurement time, the better for the explanation. However, when it is too short, serious measurement erros are caused, and hence, it is unsuitable for practical use. The measurement time is 5 seconds which allows stable measurement and explanation of the effects obtained in this invention. That is to say, the measurement is carried out in the same way as in JIS P 8140, except that the period of contact with water is 5 seconds.

In this invention, it is desirable to pass the coated paper through the nip of rolls at a linear pressure of 1–50 kg/cm, preferably 10–40 kg/cm at a paper surface temperature lower than the Tg of the synthetic polymer latex having a Tg of at least 38° C. immediately before mirror-finishing the coated paper by means of a hot calender.

It is stated in U.S. Pat. No. 2,293,278 and Japanese patent publication No. 25,482/76 that in order to make the coated surface smooth before sending it to a hot calender, water is applied to the surface of the coated paper, after which the coated paper is passed through the nip. However, this method is basically different from the method used in this invention. That is to say, in the method used in this invention, care should be taken to avoid the incorporation of water into the surface of the coated paper before passing said coated paper between the rolls, which adversely affect the surface of the subsequent hot calender in respect of staining. That is to say, the coated paper is passed through the nip at a linear pressure of 1–50 kg/cm under such conditions that the paper surface temperature does no exceed the Tg of the polymer latex in the coating solution, immediately before the coated paper is introduced into the hot calender, whereby stain on the subsequent hot calender is prevented, and consequently, a coated paper good in smoothness and excellent in printability is produced with good workability. A linear pressure at the nip of 1–50 kg/cm is effective though it is particularly preferably 10–40 kg/cm.

However, when the surface temperature of the coated paper exceeds the Tg of the synthetic polymer latex (A) in the coating layer at the nip prior to entering the hot calender in this invention, the surface of the coated paper becomes ununiform at the nip, and a sufficiently glossy surface cannot be obtained in the subsequent hot calender. When the linear pressure at the nip exceeds 50 kg/cm, a trouble of stain occurs at the nip of the rolls and the object cannot be accomplished. When it is lower than 1 kg/cm, the desired improvement of the surface is not expected.

The pigment for coated paper used in this invention is not particularly limited, and conventional pigments may be used such as clay, calcium carbonate, aluminum hydroxide, titanium dioxide, satin white, plastic pigments and the like. As the binder usable together with the synthetic polymer latices having a Tg of 5°–25° C. and a Tg of at least 38° C., there may be used aqueous binders, for example, protein binders such as casein, soybean protein and the like which are usually used, starch binders such as oxidized starch, phosphorylated starch and the like, cellulose derivatives such as carboxymethyl cellulose, hydroxyethyl cellulose, and the like, synthetic polymr binders such as polyvinyl alcohol, olefin-maleic anhydride resin, and the like. Further, synthetic polymer latices having a Tg other than the Tg prescribed in this invention may be used.

However, the addition of any of these binders tends to reduce the paper gloss of the coated paper, therefore the added amount should preferably be as small as possible. However, the effect of this invention is not entirely lost even if they are used.

Anti-foaming agents, coloring agents, mold-releasing agents, fludity-modifiers and the like may properly be used, if necessary.

For the coating according to this invention, there may be used any of a blade coater, an air knife coater, a roll coater, a brush coater, a curtain coater, a champlex coater, a bar coater, a gravure coater, and the like which are used for producing general pigment-coated paper, though a blade coater is particularly preferred from the viewpoint of the mirror-finishing. Multiple-layer coating may also be carried out by means of one or several kinds of coating machines in order to obtain more excellent surface quality. The amount of the top coating is usually 8–40 g/m$^2$, preferably 10–30 g/m$^2$ in terms of dry weight. For the drying after the coating, there is employed a usual drying method, for example, gas-heating, electric heating, steam heating, hot-air heating, or the like.

For the hot calender treatment, a super-calender, a gloss-calender, and the like may be used as mentioned above, though considering high productivity and the bulkiness of the coated paper, the on-line treatment by a gloss-calender is thought to be most preferable.

PREFERRED EMBODIMENT OF THE INVENTION

This invention is further explained below referring to Examples, which are not be way of limitation but by way of illustration. All "part" and "%" in the Examples are by weight, unless otherwise specified.

The method for measuring the values of properties in Examples is shown below.

(1) Degree of paper gloss (%): It was measured as 75° and 20° mirror surface gloss by means of a gloss-measuring apparatus (manufactured by Nihon Rigaku K. K.)

(2) Degree of print gloss (%): After printing with a predetermined amount of an ink and drying by means of a RI printability tester (manufactured by Akira Seisakusho), 60° gloss was measured by means of a gloss-measuring apparatus (manufactured by Nihon Rigaku K. K.).

(3) Ink setting: The sample was put into print by means of a RI printability tester, and then allowed to stand at 20° C. at a humidity of 65% for one minute, after which the print was transcribed onto white ground paper, and whether the ink setting of the sample was good or bad was judged. The ink setting becomes worse in order of o→ Ⓐ →Δ→x.

(4) Coated-surface strength: The surface strength: of the coated paper was judged by means of a RI printability tester.

Dry condition: The sample was put into print in an ink having a fixed tack, and the surface of the sample was observed.

Wet condition: A very small amount of water was given onto the sample, immediately after which the sample was put into print in an ink having a fixed tack, and the surface of the sample was observed.

The coated surface strength becomes worse in order of 5→1.

(5) Smoothness (mmHg): It was measured by means of a Smstar smoothness measurer (manufactured by Toei Denshi Kogyo K. K.).

(6) Stain on the gloss-calender: The condition of adhesion of the coating solution to a gloss-calendering apparatus was judged with the naked eye. o shows no adhesion and the adhering amount becomes larger in order of Δ→⊠→χ.

(7) Stain on the rolls: The condition of adhesion of the coating solution to the rolls immediately before entering the gloss-calendering apparatus was judged with the naked eye. o shows no adhesion and the adhering amount becomes larger in order of Δ→⊠→χ.

Referential Example

A mixed pigment consisting of 90 parts of kaolin clay and 10 parts of precipitated calcium carbonate was dispersed into water by use of 0.5 part of sodium pyrophosphate to prepare a clay slurry having a solid content of 71%. To the slurry were added 2 parts of phosphorylated starch and 13 parts of one of the three styrene-butadiene latices having a Tg of −20° C., 0° C. and 10° C., and the resulting mixtures were sufficiently mixed and stirred to prepare three coating solutions I, II and III, respectively, which had a total solid content of 63%. A paper of 78 g/m² was coated on one side with each of the coating solutions in an amount of 15 g/m² in terms of dry solids by means of a blade coater, and then dried by passing it through an air cap dryer heated at 120° C.

The dried sheet was mirror-finished by means of a gloss-calender having two pressing rolls at a linear pressure of 25 kg/cm at a surface temperature of the gloss-calender of 100° C. at a rate of 100 m/min (the paper surface temperature after the treatment was (68° C.). The properties of the coated paper obtained are described in Table 1.

TABLE 1

| S-No. | Coating solution No. | 75° White-paper gloss (%) | Print gloss (%) | Coated surface strength Dry | Coated surface strength Wet |
|---|---|---|---|---|---|
| 1 | I | 50 | 68 | 5.0 | 3.0 |
| 2 | II | 53 | 70 | 4.0 | 3.0 |
| 3 | III | 60 | 87 | 4.5 | 5.0 |

It can be seen from the results in Table 1 that the coated paper S-No. 3 obtained by using a latex having a Tg of 10° C. is excellent in paper gloss, coated surface strength in the wet condition, and print gloss. However, it is not sufficient as high-gloss coated paper in respect of white-paper gloss.

EXAMPLE 1

A mixed pigment consisting of 90 parts of kaolin clay and 10 parts of a plastic pigment was dispersed in water by use of 5 parts of sodium pyrophosphate to prepare a clay slurry having a solid content of 71%. To the slurry were added 0.3 part of sodium alignate, 2 parts of phosphorylated starch and 20 parts of a styrene-butadiene latex having a Tg of 10° C., and the resulting mixture was sufficiently mixed and stirred to prepare a coating solution IV having a total solid content of 62%. A coating solution prepared in the same manner as above, except that 15 parts of a styrene-butadiene latex having a Tg of 60° C. and 5 parts of a styrene-butadiene latex having a Tg of −10° C. were substituted for the 20 parts of the styrene-butadiene latex having a Tg of 10° C., was named a coating solution V. A coating solution prepared in the same manner as above, except that 15 parts of a styrene-butadiene latex having a Tg of 60° C. and 5 parts of a styrene-butadiene latex having a Tg of 10° C. were substituted for the 20 parts of the styrene-butadiene latex having a Tg of 10° C., was named a coating solution VI. A coating solution prepared in the same manner as above, except that 15 parts of a styrene-butadiene having a Tg of 60° C. was substituted for the 20 parts of the styrene-butadiene latex having a Tg of 10° C., was namded a coating solution VII.

A paper of 78 g/m² was coated with each of the above coating solutions in an amount of 18 g/m² in terms of dry solids by means of a blade coater, and then dried by passing it through an air cap dryer heated at 120° C. Further, the dried sheet was mirror-finished by means of a gloss-calender having two pressing rolls at a linear pressure of 25 kg/cm at a rate of 75 m/min., controlling the gloss-calender having two pressing rolls at a linear pressure of 25 kg/cm at rate of 75 m/min., controlling the gloss-calender temperature so that the paper surface temperature immediately after entering the gloss-calender was (A) 70° C. or (B) 50° C. The properties of the coated papers obtained are shown in Table 2.

TABLE 2

| S-No. | Coating solution No. | Gloss-calendering condition | Paper gloss (%) 75° | Paper gloss (%) 20° | Print gloss (%) | Ink setting | Coated surface strength Dry | Coated surface strength Wet | Remarks |
|---|---|---|---|---|---|---|---|---|---|
| 4 | IV | A | 58 | 6 | 83 | Δ | 5 | 5 | Comparative Example |
| 5 | V | A | 75 | 13 | 80 | Δ | 4.5 | 3 | Comparative Example |
| 6 | VI | A | 82 | 20 | 88 | o | 5 | 5 | The present invention |
| 7 | VII | A | 83 | 21 | 76 | o | 2 | 2 | Comparative Example |
| 8 | V | B | 73 | 10 | 70 | Δ | 3.5 | 2 | Comparative Example |
| 9 | VI | B | 80 | 18 | 78 | o | 4 | 4 | Comparative Example |
| 10 | VII | B | 81 | 20 | 60 | o | 1 | 1 | Comparative Example |

It is clear from the results in Table 2 that the coated paper S-No. 6 is superior in properties to other coated papers.

EXAMPLE 2

A mixed pigment consisting of 80 parts of kaolin clay, 10 parts of a plastic pigment and 10 parts of heavy calcium carbonate was dispersed in water by using 5 parts of sodium pyrophosphate to prepare a clay slurry having a solid content of 71%. To the slurry were added 0.4 parts of sodium alginate, 15 parts of a styrene-butadiene latex (A) having a Tg of 48° C., and a styrene-butadiene latex (B) having a Tg of 10° C. in an amount of 20 parts, 15 parts, 10 parts, 5 parts, 3 parts, 1.5 parts or 1 part to prepare 7 mixtures and these mixtures were sufficiently stirred to prepare 7 coating solutions Nos. VIII, IX, X, XI, XII, XIII and XIV, respectively, which had a total solid content of 62%.

The coating solutions were subjected to coating and gloss-calender treatment in the same way as shown in the Referential Example.

The properties of the coated paper obtained are described in Table 3.

TABLE 3

| S-No. | Coating solution No. | Paper gloss (%) 75° | Paper gloss (%) 20° | Print gloss (%) | Ink setting | Coating surface strength Dry | Coating surface strength Wet | Latex (A)/Latex (B) |
|---|---|---|---|---|---|---|---|---|
| 11 | VIII | 75 | 10 | 82 | x | 5 | 5 | 1/1.33 |
| 12 | IX | 79 | 16 | 84 | Ⓐ | 5 | 5 | 1/1.0 |
| 13 | X | 81 | 19 | 86 | o | 5 | 5 | 1/0.67 |
| 14 | XI | 82 | 20 | 86 | o | 5 | 5 | 1/0.33 |
| 15 | XII | 83 | 20 | 85 | o | 5 | 5 | 1/0.2 |
| 16 | XIII | 83 | 20 | 82 | o | 3 | 3 | 1/0.1 |
| 17 | XIV | 83 | 20 | 78 | o | 2 | 1 | 1/0.07 |

It is clear from Table 3 that the coated paper S-Nos. 12 to 16, particularly S-Nos. 13 to 15 have excellent properties as high-gloss coated paper.

EXAMPLE 3

In the same manner as in Example 1, a coating solution VI was prepared. With this coating solution was coated a paper of 78 g/m$^2$, the Cobb size degree after 5 seconds of which was (A) 0.2 g/m$^2$, (B) 1.5 g/m$^2$, (C) 6 g/m$^2$, (D) 9.8 g/m$^2$, or (E) 15 g/m$^2$ with a varying amount of an inner sizing agent in the same manner as in Example 1, and then dried. The resulting coated paper was mirror-finished in the same manner as in Example 1, except that the floss-calender temperature was 70° C.

The properties of the 5 coated papers obtained are shown in Table 4.

TABLE 4

| S-No. | Paper used | Paper gloss (%) 75° | Paper gloss (%) 20° | Print gloss (%) | Coated surface strength Dry | Coated surface strength Wet | Smoothness (mmHg) |
|---|---|---|---|---|---|---|---|
| 18 | A | 82 | 20 | 86 | 3 | 3 | 12 |
| 19 | B | 82 | 20 | 86 | 4.5 | 4 | 12 |
| 20 | C | 82 | 20 | 88 | 5 | 5 | 10 |
| 21 | D | 80 | 18 | 85 | 5 | 5 | 14 |
| 22 | E | 77 | 14 | 80 | 5 | 5 | 23 |

As shown in Table 4, S-Nos. 19, 20 and 21, are particularly S-No. 20, are excellent.

EXAMPLE 4

A pigment consisting of 90 parts of kaolin and 10 parts of precipitated calcium carbonate was dispersed in water by use of 0.2 part of sodium pyrophosphate to prepare a clay slurry containing 70% of solid pigment. To the slurry were added 1 parts of phosphorylated starch, 13 parts of a styrene-butadiene latex having a Tg of 40° C. and 3 parts of a styrene-butadiene latex having a Tg of 10° C., and the resulting mixture was sufficiently stirred to prepare a coating solution having a total solid content of 62%. A paper of 80 g/m$^2$ was coated with the coating solution in an amount of 16 g/m$^2$ in terms of dry solids by means of a blade coater, and the coated paper was dried by passing it through an air cap dryer heated at 120° C. to 130° C.

Subsequently, the coated paper thus obtained was passed through the nip of rolls at a linear pressure of (A) 0.5 Kg/cm, (B) 35 Kg/cm or (C) 65 Kg/cm at a paper surface temperatiure at the nip of rolls of 35+ C., immediately before entering the gloss-calender, and then subjected to gloss-calender finishing under the gloss-calender conditions that the pressing roll pressure was 50 Kg/cm, the paper surface temperature just after the calender treatment was 70° C., and the paper speed was 75 m/min to gloss-examine the stain on the gloss-calender. The properties of four kinds of the coated papers including a coated paper which had not been passed through the roll nip are shown in Table 5.

TABLE 5

| S-No. | Roll pressure at nip (kg/cm) | Stain on roll at nip | Paper gloss (%) 75° | Paper gloss (%) 20° | Print gloss (%) | Smoothness (mmHg) | Stain on gloss-calender | Remarks |
|---|---|---|---|---|---|---|---|---|
| 23 | — | — | 70 | 9 | 70 | 25 | ✱ | Not passed through the nip of rolls |
| 24 | 0.5 | o | 70 | 9 | 70 | 25 | ✱ | |
| 25 | 35 | o | 81 | 17 | 80 | 10 | o | |
| 26 | 65 | ✱ | 68 | 7 | 60 | 30 | o | |

As shown in Table 5, S-No. 25 is a high-gloss coated paper which is excellent in paper gloss and smoothness, does not stain the gloss-calender, and hence has desirable characteristics. Further, as in S-No. 26, when the roll pressure at nip is too high, the stain on roll at nip is much though the stain on the gloss is little. Therefore, the white-paper gloss and the print gloss are low and the smoothness is greatly low.

EXAMPLE 5

A mixed pigment consisting of 70 parts of kaolin clay, 15 parts of a plastic pigment and 15 parts of heavy calcium carbonate was dispersed in water by use of 0.7 part of sodium pyrophosphate to obtain a clay slurry having a solid content of 71%. To the slurry were added 0.3 part of carboxymethyl cellulose, 5 parts of a methyl methacrylate-butadiene copolymer latex having a Tg of 5° C., and 13 parts of a styrene-butadiene latex having a Tg of 60° C., and the resulting mixture was sufficiently stirred to obtain a coating solution having a total solid content of 63%. A paper of 78 g/m$^2$ was coated with the coating solution in an amount of 17 g/m$^2$ in terms of dry solids by means of a blade coater, and then dried by means of an air cap dryer. The dried sheet was passed through the roll nip at a linear pressure of 40 kg/cm at a paper surface temperature just after the paper had been passed through the roll nip of (D) 50° C., (E) 65° C., and the resulting two coated papers were brought into contact with a gloss-calendering apparatus under pressure, and then subjected to mirror-finish at such a gloss-calender temperature that the paper surface temperature after the treatment was 72° C. Subsequently, the condition of stain on the roll at the nip and the physical properties of the two coated papers were examined.

The results are shown in Table 6.

TABLE 6

| S-No. | Paper surface temperature after the paper had been passed through the nip (°C.) | Stain on roll at nip | Paper gloss (%) 75° | Paper gloss (%) 20° | Print gloss (%) | Smoothness (mmHg) | Stain on gloss-calender |
|---|---|---|---|---|---|---|---|
| 27 | 50 | o | 82 | 21 | 82 | 10 | o |
| 28 | 65 | Δ | 70 | 10 | 65 | 28 | Δ |

As is clear also from the results in Table 6, S-No. 27 is good in paper gloss, print gloss and smoothness as compared with S-No. 28.

EXAMPLE 6

In the same manner as in Example 1, a coating solution VI was prepared. Four coating solutions XV, XVI, XVII and XVIII were prepared by replacing the styrene-butadiene latex having a Tg of 10° C. in the coating solution VI by styrene-butadiene latices having Tg of 0° C., 5° C., 25° C. and 30° C., respectively. The same procedure as in Example 1 was repeated using the five coating solutions thus prepared to prepare 5 coated papers, in which the paper surface temperature just after the coated paper had been passed through the nip of rolls was adjusted to 70° C. The properties of the coated papers obtained are shown in Table 7.

TABLE 7

| S-No. | Coating solution No. | Paper gloss (%) 75° | Paper gloss (%) 20° | Print gloss (%) | Ink-setting | Coated surface strength Dry | Coated surface strength Wet | Remarks |
|---|---|---|---|---|---|---|---|---|
| 29 | XV | 78 | 15 | 88 | Ⓐ | 5 | 5 | Comparison |
| 30 | XVI | 81 | 19 | 89 | Ⓐ | 5 | 5 | Example |
| 6 | VI | 82 | 20 | 88 | o | 5 | 5 | Example |
| 31 | XVII | 82 | 20 | 86 | o | 4.5 | 4.5 | Example |
| 32 | XVIII | 83 | 20 | 78 | o | 2 | 3 | Comparison |

From Table 7, it can be seen that S-Nos. 6, 30 and 31, which are of the present invention, are coated papers excellent in all of the paper gloss, print gloss, ink setting, and coated surface strength.

What is claimed is:

1. A process for producing a high-gloss coated paper by coating a paper or a prime-coated paper with an aqueous coating solution comprising a synthetic polymer latex (A) having a glass transition temperature of at least 38° C., a synthetic polymer latex (B) having a glass transition temperature of 5° to 25° C., and a pigment for coated papers, drying the coated paper, and then bringing the coated surface into contact with a hot calender under pressure at a temperature not lower than the glass transition temperature of the synthetic polymer latex (A), thereby mirror-finishing the coated paper, characterized in that the weight ratio (as solids) of the synthetic polymer latex (A) to the synthetic polymer latex (B) is 1:0.2–1:0.67.

2. A process according to claim 1, wherein the Cobb size degree of the paper or the prime-coated paper is 0.4–10 g/m$^2$.

3. A process according to claim 2, wherein the Cobb size degree of the paper or the prime-coated paper is 2–7 g/m$^2$.

4. A process according to claim 1 or 2, wherein the coated paper is passed through the nip of the rolls under the conditions that the linear pressure is 1–50 kg/cm and the paper surface temperature is lower than the glass transition temperature of the synthetic polymer latex (A), immediately before mirror-finishing the coated paper by bringing the coated surface into contact with a hot calender under pressure.

5. A process according to claim 4, wherein the linear pressure is 10–40 kg/cm.

6. A process according to claim 1, wherein the hot calender is a gloss calender.

* * * * *